US005112204A

United States Patent [19]

Parsons

[11] Patent Number: 5,112,204

[45] Date of Patent: May 12, 1992

[54] OSCILLATORY ROTATING ENGINES WITH ROTOR SPEED CONTROL

[75] Inventor: Bryan N. V. Parsons, Stoney Stanton, United Kingdom

[73] Assignee: Jaguar Cars Limited, United Kingdom

[21] Appl. No.: 613,157

[22] Filed: Nov. 13, 1990

[30] Foreign Application Priority Data

Nov. 15, 1989 [GB] United Kingdom ..... 8925868

[51] Int. Cl.[5] ..... F01C 1/07

[52] U.S. Cl. ..... 418/36; 418/40

[58] Field of Search ..... 418/36, 37, 38, 40; 123/245

[56] References Cited

U.S. PATENT DOCUMENTS

| | | | |
|---|---|---|---|
| 1,732,995 | 10/1929 | Tsuchudi | 418/36 |
| 2,211,292 | 8/1940 | Ryerson | 418/36 |
| 2,899,944 | 8/1959 | Patkau . | |
| 3,753,630 | 8/1973 | Sadahiro | 418/36 |
| 3,922,118 | 11/1975 | Bancroft . | |
| 3,937,187 | 2/1976 | Bergen | 418/36 |
| 4,072,447 | 2/1978 | Gaspar | 418/36 |
| 4,136,661 | 1/1979 | Posson | 418/36 |
| 4,311,442 | 1/1982 | Simon | 418/37 |

FOREIGN PATENT DOCUMENTS

| | | | |
|---|---|---|---|
| 991631 | 4/1944 | France . | |
| 976094 | 10/1950 | France | 418/36 |
| 1488266 | 3/1966 | France . | |
| 2101263 | 1/1983 | United Kingdom . | |
| 2101263 | 1/1983 | United Kingdom . | |
| 2219630 | 12/1989 | United Kingdom | 418/36 |

*Primary Examiner*—Richard A. Bertsch
*Assistant Examiner*—David L. Cavanaugh
*Attorney, Agent, or Firm*—Davis, Bujold & Streck

[57] ABSTRACT

An oscillatory rotating engine has a pair of rotors each defining a pair of diametrically opposed radially extending lobes, the rotors are mounted for rotation within a cylindrical housing and sealingly engage the walls of the cylindrical housing to define four working chambers. Each rotor is drivingly connected to an output shaft by means of an internal/external gear train, the external gear being mounted for rotation with the rotor and the internal gear being mounted rotatably with respect to the output shaft for orbital motion in mesh with the external gear. Each internal gear has an arm with a longitudinal slot which is engaged by a pivotal block which will act to rotationally restrain the internal gear and impose a periodic variation in velocity on the gear train, this periodic variation in velocity for the two rotors being out of phase so that the working chambers are alternately expanded and reduced in volume.

17 Claims, 4 Drawing Sheets

OSCILLATORY ROTATING ENGINES WITH ROTOR SPEED CONTROL

BACKGROUND TO THE INVENTION

The present invention relates to oscillatory rotating engines and in particular to engines of the Kauertz type.

The Kauertz engine comprises a pair of concentric rotors, each having a pair of diametrically opposed sectors which sealingly engage the end walls and circumferential surface of a cylindrical housing, to define four working chambers, each working chamber defined between a sector on one rotor and a sector on the other rotor. The rotors are driven about their common axis, their relative angular velocity varying so that the volume of each working chamber is alternately expanded and then contracted. An inlet port, exhaust port and ignition device are provided at appropriate points on the cylindrical housing, so that the expansion and contraction of the working chambers will provide induction, compression, expansion and exhaust strokes.

One of the rotors is driven by a gear and linkage mechanism which will provide two oscillations per rotation of the rotor and thus two contraction and two expansion phases for each working chamber on each rotation of the rotors. One rotation of the rotor will thus be equal to a conventional four stroke cycle.

The drive mechanisms used hitherto to control the complicated oscillatory motion, are relatively complex and difficulties have been experiended with the strength of this mechanism. This drive mechanism is also excessively noisy.

In our co-pending patent application Ser. No. 07/609,594 filed Nov. 6, 1990 we disclose an oscillatory drive mechanism which is relatively simple and robust. Furthermore, with this drive, the varying drive ratio is adjustable, so that the compression ratio of the engine may be adjusted by adjustment of the drive mechanism.

SUMMARY OF THE INVENTION

According to one aspect of the present invention an oscillatory rotating engine comprises; a pair of rotors, each rotor defining a pair of diametrically opposed radially extending lobes, the rotors being mounted coaxially of one another within a cylindrical housing defined by a pair of end walls and a cylindrical wall, the lobes in sealing enegagement with the end walls and cylindrical wall of the cylindrical housing to define four working chambers; the rotors being drivingly connected to an output shaft, one of the rotors being connected to the output shaft by means of an internal/external gear train, one of the gears being mounted for rotation with said one rotor, the other gear being mounted for orbital motion in mesh with said one gear, said other gear being rotatably connected to the output shaft, the gear mounted for orbital motion having a formation which engages a complementary formation, the formation on the gear being capable of linear and pivotal movement relative to said complementary formation; the other rotor being drivably connected to the output shaft for rotation in the same direction as said one rotor and at the same overall velocity ratio.

With the mechanism described above, inter-engagement of the formation on the gear mounted for orbital motion with the complementary formation will impose an oscillatory rotation on that gear and as a result, the velocity of said other gear and the rotor attached thereto, will be constrained to vary relative to the velocity of the shaft. The other rotor may be restrained by suitable means to move at the same velocity as said one rotor so that variation in the velocity of the rotor associated with the gear train will cause said rotor to move relative to the other rotor thus controlling expansion and contraction of the working chambers defined between the rotors. Preferably, both rotors are controlled by internal/external gear trains of the form described above, the variation in velocities of the rotors being 180° out of phase, so that as one rotor speeds up the other slows down causing the rotors to move together and then apart to provide the contraction and expansion phases required.

BRIEF DESCRIPTION OF THE DRAWINGS

The invention is now described, by way of example only, with reference to the accompanying drawings, in which.

DESCRIPTION OF A PREFERRED EMBODIMENT

Figure 1:
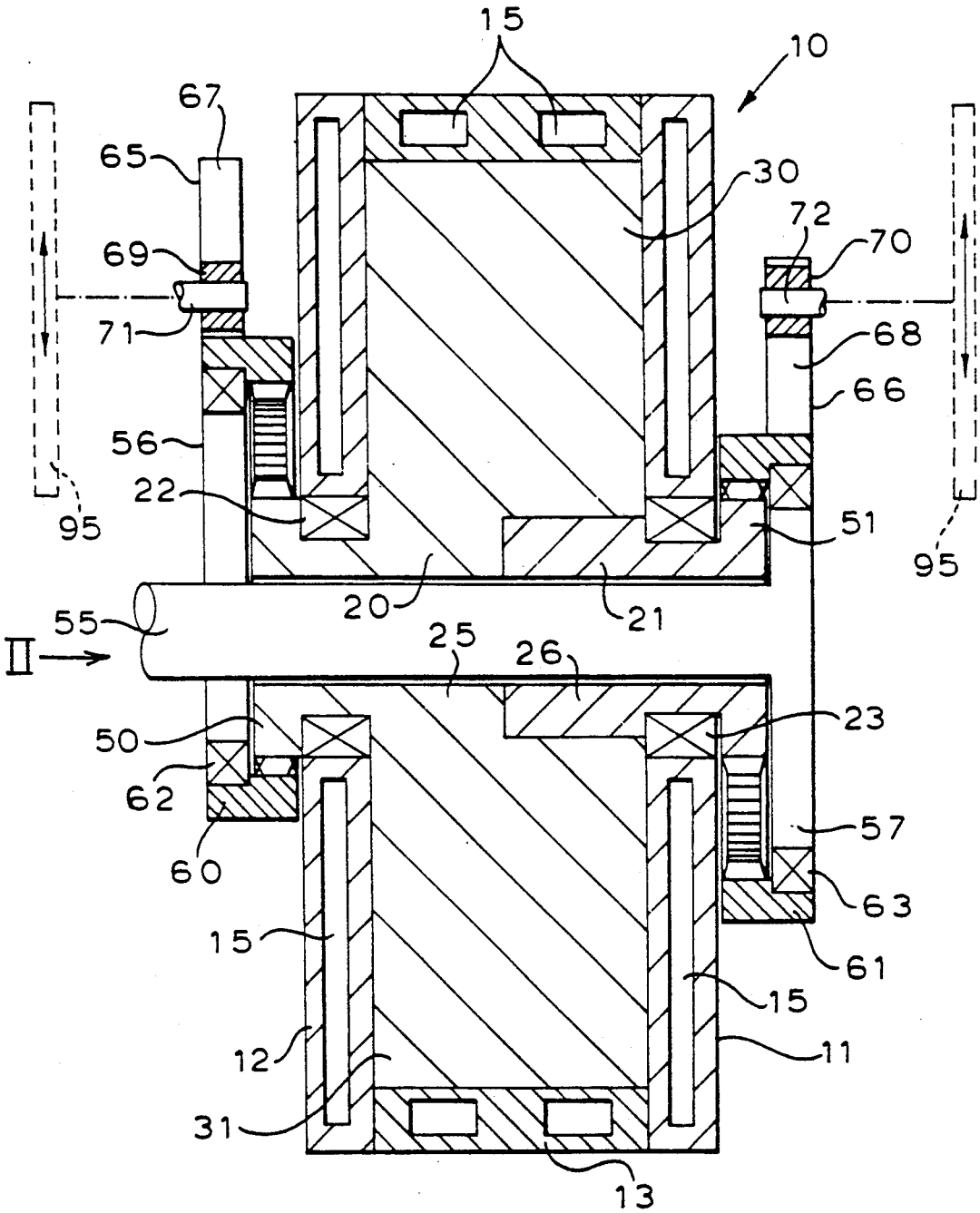
FIG. 1 illustrates in part sectional elevation an oscillatory rotating engine in accordance with the present invention.
Figure 2:
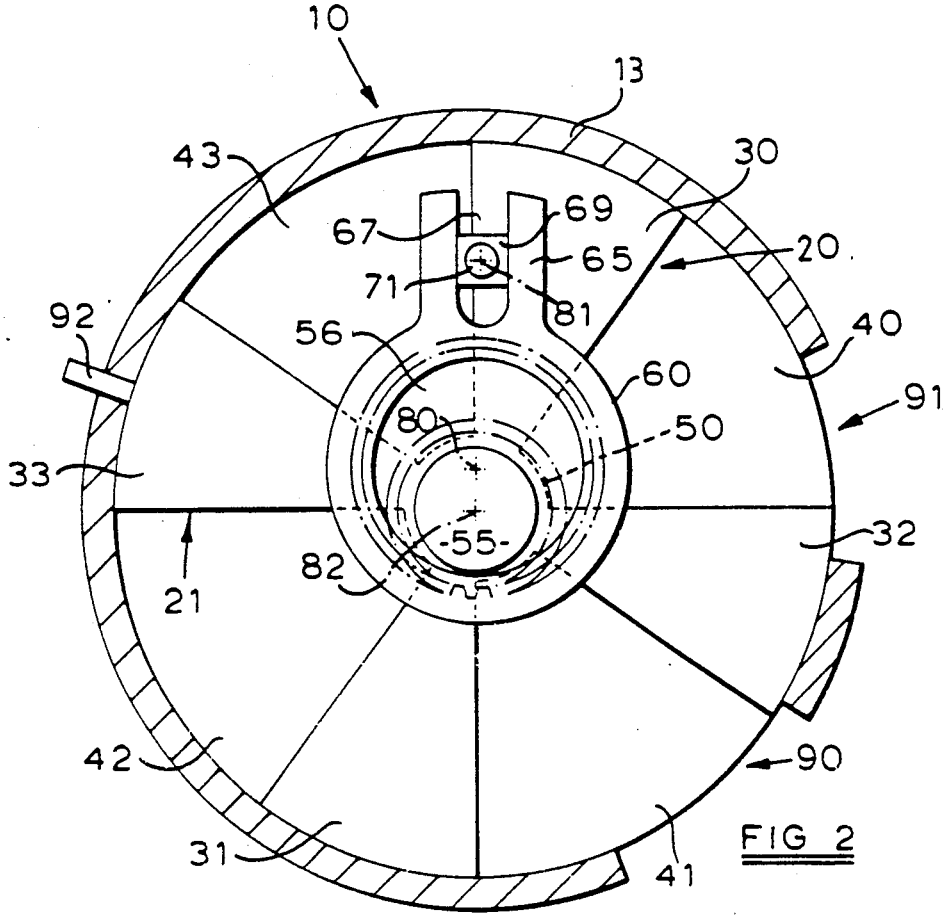
FIG. 2 is a part sectional illustration in the direction of Arrow II in FIG. 1.

An oscillatory rotating engine as illustrated in FIGS. 1 and 2, has a cylindrical housing 10 formed by a pair of annular end walls 11 and 12 and a cylindrical wall 13 which are bolted together in suitable manner. The walls 11, 12 and 13 are provided with passages 15 through which a coolant may be circulated.

A pair of rotors 20 and 21 are mounted coaxially of one another, within the housing 10 in bearings 22 and 23 respectively. Each rotor 20, 21 comprises a hollow cylindrical core 25, 26 which extends half the width of the housing 10, a seal being provided between the juxtaposed ends of the cores 25 and 26 in a manner which will permit relative movement therebetween.

Each of the rotors 20, 21 has a pair of diametrically opposed radially extending sectoral lobes, 30, 31, 32, and 33 respectively. The lobes, 30, 31, 32 and 33 extend the full width of the housing 10, sealing means being provided to produce a seal between each lobe 30, 31, 32 and 33 and; the core 26, 25 of the other rotor 21, 20; the end walls 11, 12 of the housing 10; and the cylindrical wall 13 of the housing 10. The lobes 30, 3I, 32 and 33 thereby divide the housing 10 into four working chambers 40, 41, 42 and 43, each working chamber 40, 41, 42 and 43 being defined between a lobe 30, 31 on one rotor 20 and a lobe 32, 33 on the other rotor 21.

Each rotor 20, 21 is drivingly connected to a gear 50, 51. A shaft 55 is mounted coaxially of the rotors 20 and 21 and passes through the middle thereof. The shaft 55 has a pair of eccentrics 56 and 57, each positioned in juxtaposed relationship to one of the gears 50 and 51.

The eccentrics 56 and 57 are of equal dimensions, but are positioned 180° out of phase, on the shaft 55. Internal gears 60 and 61 are rotatably mounted one on each of the eccentrics 56 and 57, by means of bearings 62 and 63, the internal gears 60, 61 meshing with gears 50, 51 respectively.

An arm 65, 66 extends radially from each of the external gears 60 and 61, the arms 65 and 66 having radially extending slots 67 and 68. Blocks 69 and 70 are pivotally mounted on pins 71 and 72, one block 69, 70 slidingly engaging in each of the slots 67 and 68. The pins 71 and 72 are mounted at equal distances from the axis of shaft 55, means 95 being provided for adjustment of this distance, as required.

The rotors 20, 21 are arranged such that when the centre 80 of each eccentric 56, 57 is co-linear with the axis 81 of pin 71, 72 and the axis 82 of shaft 55, the lobes 30, 31 of rotor 20 will be disposed at right angles to the lobes 32, 33 of rotor 21, as illustrated in FIG. 2.

An inlet port 90, exhaust port 91 and ignition device 92 are provided through the central wall 15 of housing 10. The inlet port 90 is connected to a fuel/air source and the exhaust port 91 to an exhaust system, of conventional design.

Upon rotation of the rotors 20 and 21 and gears 50 and 51 connected thereto, the internal gears 60 and 61 will be driven to perform an eccentric oscillation, rotation of the internal gears 60 and 61 being prevented by engagement of blocks 69 and 70 in slots 67 and 68. This eccentric oscillation of internal gears 60 and 61 is converted into rotational motion of the shaft 55 by the eccentrics 56 and 57. The ratio of the diameters of the gears 50, 51 and the internal gears 60 and 61 is 2:3, giving an overall drive ratio of 1:2 between the rotors 20, 21 and shaft 55.

As the internal gears 60, 61 undergo eccentric oscillation, the blocks 69 and 70 slide within slots 67 and 68, but as illustrated in FIGS. 3 to 6, the arms 65 and 66 are tilted first to one side and then to the other, imposing a rotational oscillation on the internal gears 60 and 61. As a result of this rotational oscillation, a substantially sinusoidal variation in angular velocity is imposed on the rotors 20, 21.

As illustrated in FIGS. 3 to 6 and FIG. 7, each rotor 20, 21 will speed up and then slow down, twice per revolution. As the eccentrics 56 and 57 are 180° out of phase, the speeding up of one rotor 20 is timed to occur as the other rotor is slowing down and vice versa, so that the lobes 30, 31, 32, and 33 of the two rotors 20, 21 will alternately move together and then apart.

Figure 3:
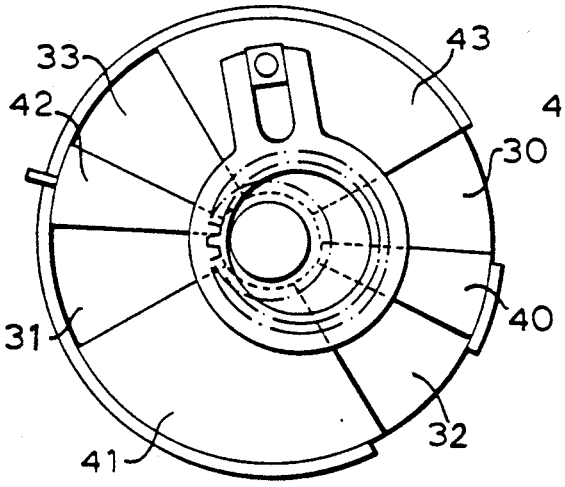
FIGS. 3 to 6 are views similar to FIG. 2 illustrating the various phases of the engine cycle.
Figure 4:
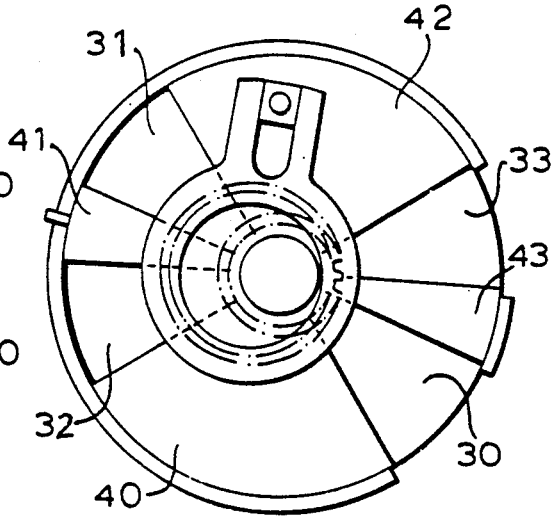
Figure 5:
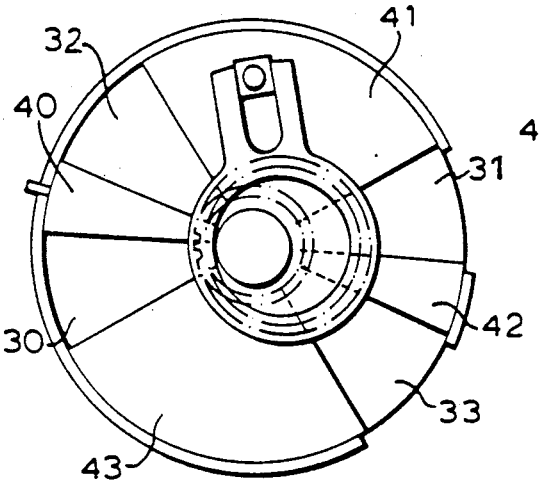
Figure 6:
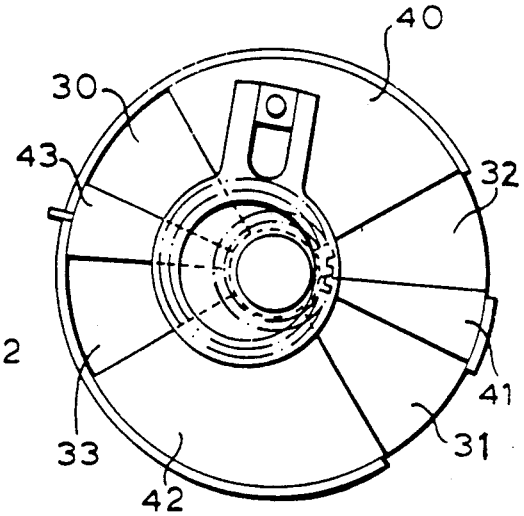

Considering one of the working chambers 41; as the rotors 20, 21 move from the position illustrated in FIG. 2 to that illustrated in FIG. 3, the speed of rotor 20 is increased while the speed of rotor 21 is reduced; lobe 31 will consequently move away from lobe 32 causing the volume of working chamber 41 to increase, drawing air/fuel mixture into the chamber 41 through inlet port 90. As the rotors 20, 21 move from the position illustrated in FIG. 3 to that illustrated in FIG. 4, rotor 20 is slowed down while rotor 21 is speeded up; lobe 32 will consequently move towards lobe 31 compressing the air/fuel mixture in working chamber 41, so that it may be detonated by the ignition device 92. Between the positions illustrated in FIGS. 4 and 5, rotor 20 is speeded up while rotor 21 slows down so that the lobe 31 moves away from lobe 32 permitting the detonated air/fuel mixture to expand. Finally between positions illustrated in FIGS. 5 and 6, rotor 20 slows down while rotor 21 speeds up causing lobe 32 to move towards lobe 31 and expel the exhaust gases from the working chamber 41 through the exhaust port 91.

It will be appreciated that for every rotation of the rotors 20 and 21, each of the four working chambers 40, 41, 42 and 43 will undergo the cycle described above, giving four detonations per revolution.

Figure 7:
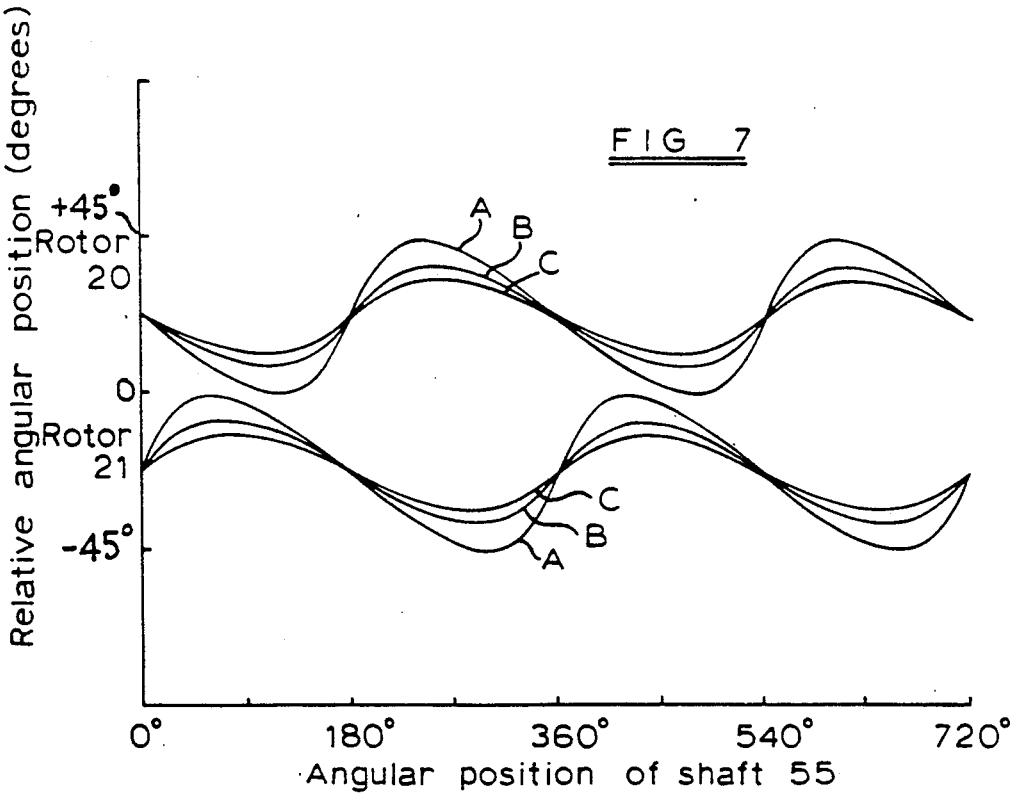
FIG. 7 is a graph showing the relative angular position of the rotors relative to the angular position of the shaft, for the engine illustrated in FIG. 1.

The tilting of the arms 65 and 66 and hence the angular magnitude of the rotational oscillation imposed on internal gears 60 and 61, will depend upon the separation between the axes 81 of pins 71 and 72 and the axis 82 of shaft 55. By varying this separation, the variation in velocities of the rotors 20 and 21 and thus the relative angular movement between rotors 20 and 21 may be adjusted, thus varying the compression ratio of the engine FIG. 7 shows a plot of relative angular position of the rotors 20 and 21, relative to the angular position of the shaft, over one revolution of the rotors 20 and 21. It will be noted, that due to the 1:2 drive ratio from rotors 20 and 21 to shaft 55, one revolution of the rotors 20, 21 is equivalent to two revolutions of shaft 55. The plots A, B and C for each rotor 20, 21 represent separation between axes 81 and 82 equal to two times the eccentricity of eccentrics 56 and 57; three times the eccentricity of eccentrics 56 and 57; and four times the eccentricity of eccentrics 56 and 57, respectively. As illustrated by this graph, when separation is equal to two times the eccentricity, the compression ratio is about 16:1, whereas when the separation is equal to four times the eccentricity, the compression ratio is about 3:1. However, for practical considerations the compression ratio is unlikely to be lowered below 7:1.

Figure 8:
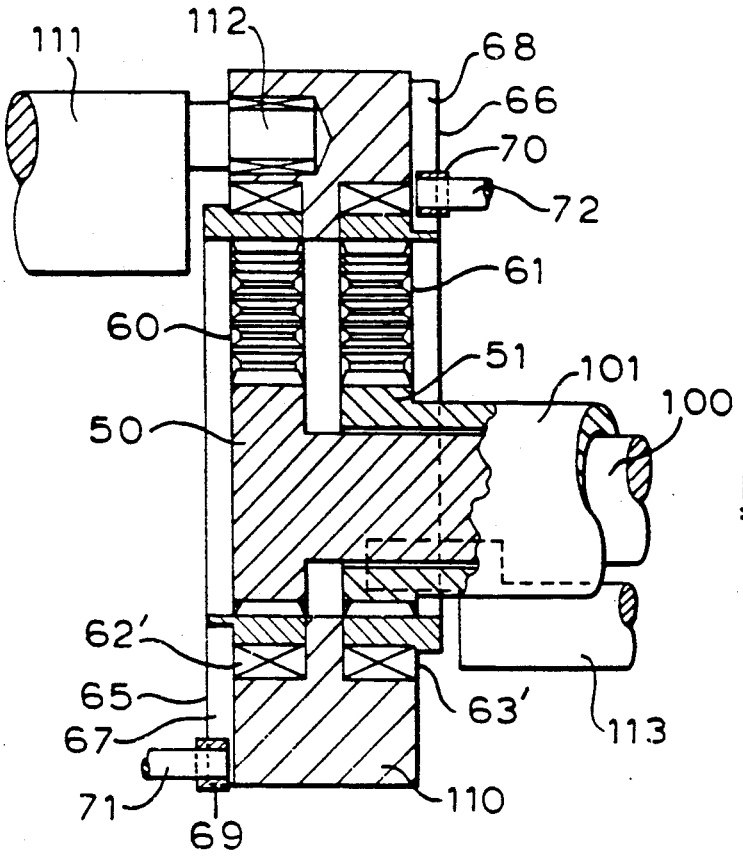
FIG. 8 is a sectional side elevation of an alternative form of drive mechanism which may be usdd on an oscillatory rotating engine in accordance with the present invention.
Figure 9:
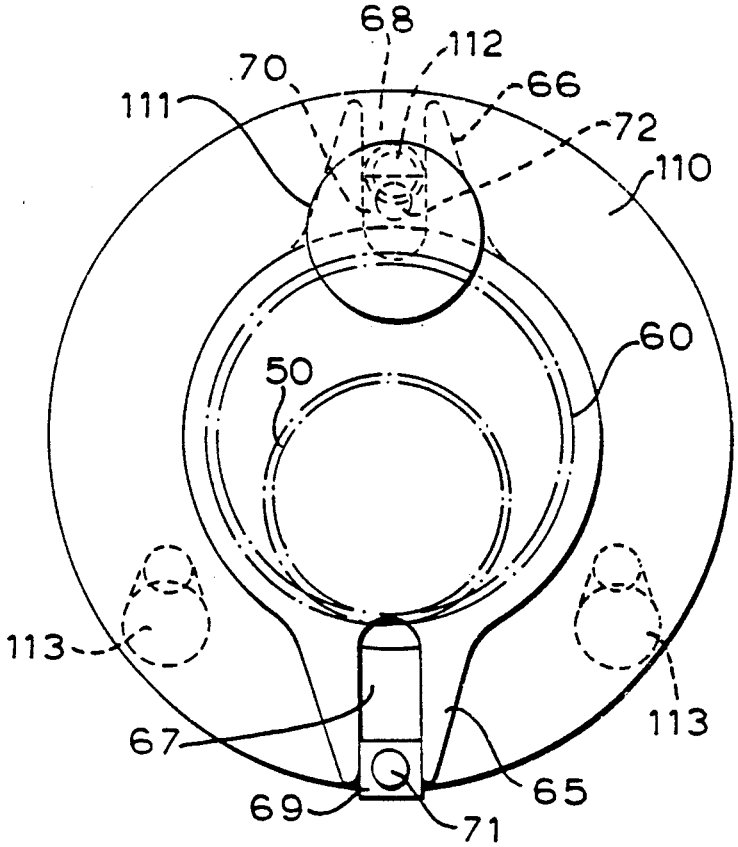
FIG. 9 is an end elevation of the drive mechanism illustrated in FIG. 8.

In the drive mechanism illustrated in FIGS. 8 and 9, the rotors 20, 21 are mounted on concentric shafts 100, 101 which extend to the same side of the cylindrical housing 10 and are rotatably mounted with respect thereto in suitable bearings. Gears 50 and 51 are mounted on the shafts 100 and 101 for rotation with the rotors 20 and 21 respectively.

The gears 50 and 51 mesh with internal gears 60 and 61 respectively, which are rotationally mounted in bearings 62' and 63' on the internal diameter of an annular link 110. The annular link 110 is connected to an output shaft 111 by means of crank 112 and a pair of idler cranks 113 constrain the annular link 110 to move in an orbital path centered on the axis of rotation of the shafts 100 and 101.

The gears 60 and 61 each have an arm 65, 66 which extends radially of the gears 60, 61. The arms 65, 66 have radially extending slots 67, 68 which are slidingly engaged by blocks 69, 70 which are pivotally mounted on pins 71 and 72. The pins 71 and 72 are located in fixed positions relative to the cylindrical housing 10, at equal distances from the axis of rotation of shafts 100 and 101 but at diametrically opposite sides thereof. Means may be provided for adjustment of the distance of pins 71 and 72 from the axis of shafts 100 and 101 in similar manner to that illustrated in FIG. 1.

The drive mechanism described with reference to FIGS. 8 and 9 will cause the velocity of the two rotors 20 and 21 to vary in similar manner to the embodiment illustrated in FIGS. 1 to 7. Although engagement of gears 56 and 57 with gears 60 and 61 is not 180° out of phase as with the previous embodiment, the variation in velocity of the two rotors 20 and 21 will still be 180° out of phase because the arms 65 and 66 are located on opposite sides.

Reaction between gears 50 and 60 and 51 and 61 will cause the annular link 110 to move about its orbital path which in turn will cause the output shaft 111 to rotate.

As with the previous embodiment the compression ratio of the engine may be varied by adjusting the distance of pins 71 and 72 from the axis of rotation of shafts 100 and 101.

Various modifications may be made without departing from the invention. For example, while in the above embodiments means is provided for varying the velocity of both rotors substantially sinusoidally, in order to produce the expansion and contraction phases of the working chambers, according to an alternative embodiment one rotor may rotate at half output shaft velocity while the substantially sinusoidal variation imposed on the other rotor provides the relative motion between the rotors which produces the expansion and contraction phases of the working chambers.

I claim:

1. An oscillatory rotating engine comprising a pair of rotors, each rotor defining a pair of diametrically opposed radially extending lobes, the rotors being mounted coaxially of one another within a cylindrical housing defined by a pair of end walls and a cylindrical wall, the lobes in sealing engagement with the end walls and cylindrical wall of the cylindrical housing to define four working chambers; the rotors being drivingly connected to an output shaft, one of the rotors being connected to the output shaft by means of an internal/external gear train, one of the gears being mounted for rotation with said one rotor, the other gear being rotatably mounted eccentrically on the output shaft so that it meshes with said one gear, said other gear having a formation which engages a complementary formation to prevent free rotation of said other gear, the formation on the other gear being capable of linear and pivotal movement relative to said complementary formation so as to impose an oscillatory rotation on said other gear; said other rotor being drivingly connected to the output shaft for rotation in the same direction as said one rotor and at the same overall velocity ratio.

2. An oscillatory rotating engine according to claim 1 in which the internal/external gear train gives an overall velocity ratio of 1:2 from rotor to output shaft.

3. An oscillatory rotating engine comprising a pair of rotors, each rotor defining a pair of diametrically opposed radially extending lobes, the rotors being mounted coaxially of one another within a cylindrical housing defined by a pair of end walls and a cylindrical wall, the lobes in sealing engagement with the end walls and cylindrical wall of the cylindrical housing to define four working chambers; the rotors being drivingly connected to an output shaft by internal/external gear trains, one of the gears of each gear train being mounted for rotation with a different one of said rotors, the other gear of each gear train being rotatably mounted eccentrically on the output shaft so that it meshes with said one gear, said other gear of each gear train having a formation which engages a complementary formation to prevent free rotation of said other gear, the formation on the other gear being capable of linear and pivotal movement relative to said complementary formation, so as to impose an oscillatory variation in velocity on each of the rotors, the variation in velocity on one rotor being out of phase with the variation in velocity on the other rotor.

4. An oscillatory rotating engine according to claim 3 in which the variation in velocity of the two rotors are 180° out of phase.

5. An oscillatory rotating engine according to claim 3 in which the complementary formations are spaced equidistantly form the axis of rotation of the gears mounted for rotation with the rotors.

6. An oscillatory rotating engine comprising a pair of rotors, each rotor defining a pair of diametrically opposed radially extending lobes, the rotors being mounted coaxially of one another within a cylindrical housing defined by a pair of end walls and a cylindrical wall, the lobes in sealing engagement with the end walls and cylindrical wall of the cylindrical housing to define four working chambers; the rotors being drivingly connected to an output shaft, one of the rotors being connected to the output shaft by means of an internal/external gear train, one of the gears being mounted for rotation with said one rotor, the other gear being rotatably mounted eccentrically on the output shaft so that it meshes with said one gear, said other gear having a formation which engages a complementary formation to prevent free rotation of said other gear, the formation on the other gear being capable of linear and pivotal movement relative to said complementary formation so as to impose an oscillatory rotation on said other gear; said other rotor being drivingly connected to the output shaft for rotation in the same direction as said one rotor and at the same overall velocity ratio; means being provided for movement of the complementary formation relative to the axis of rotation of the gear mounted for rotation with the rotor to vary the oscillatory rotation imposed on said other gear.

7. An oscillatory rotating engine according to claim 6 in which the distance between the complementary formation and axis of rotation of the gear mounted for rotation with the rotor may be varied from twice the eccentricity of the eccentric to 4 times the eccentricity of the eccentric.

8. An oscillatory rotating engine according to claim 7 in which a compression ratio may be varied from about 16:1 to about 7:1.

9. An oscillatory rotating engine according to claim 1 in which an external gear is mounted for rotation coaxially of the rotor and is drivingly connected thereto; an internal gear being mounted, in meshing engagement with the external gear, on the eccentric with suitable bearing means therebetween; the ratio of the internal to external gear being 3:2.

10. An oscillatory rotating engine according to claim 1 in which the formation associated with the eccentrically mounted gear comprises an arm with radially extending slot, the complementary formation comprising a pivotally mounted block which slidingly engages the slot.

11. An oscillatory rotating engine according to claim 1 in which each rotor comprises a hollow cylindrical core which extends half the width of the housing, sealing means being provided between the juxtaposed ends of the cores of the two rotors, each rotor having a pair of radially extending lobes which extend the full width of the cylindrical housing, the lobes being sealed with respect to the end walls, circumferential wall and core of the other rotor by suitable sealing means.

12. An oscillatory rotating engine according to claim 1 in which the lobes are sectoral.

13. An oscillatory rotating engine according to claim 1 in which an inlet port, exhaust port and ignition device are provided through the cylindrical wall of the housing.

14. An oscillatory rotating engine comprising a pair of rotors, each rotor defining a pair of diametrically opposed radially extending lobes, the rotors being mounted coaxially of one another within a cylindrical housing defined by a pair of end walls and a cylindrical wall, the lobes in sealing engagement with the end walls and cylindrical wall of the cylindrical housing to define four working chambers; the rotors being drivingly connected to an output shaft, one of the rotors being connected to the output shaft by means of an internal/external gear train, one of the gears being mounted for rotation with said one rotor, the other gear being rotatably mounted eccentrically on the output shaft so that it meshes with said one gear, said other gear having formation which engages a complementary formation to prevent free rotation of said other gear, the formation on the other gear being capable of linear and pivotal movement relative to said complementary formation so as to impose an oscillatory rotation on said other gear; said other rotor being drivingly connected to the output shaft for rotation in the same direction as said one rotor and at the same overall velocity ratio; the output shaft extending coaxially of the rotors through the centre of the rotors, said one gear being connected to the associated rotor by a shaft concentric of the output shaft, said other gear being mounted on an eccentric on the output shaft, bearing means being provided between said other gear and the eccentric to permit relative rotation therebetween.

15. An oscillatory rotating engine according to claim 14 in which internal/external gear trains are provided to both rotors, the internal/external gear trains being located one on either side of the cylindrical housing, said other gears of each gear train being rotatably mounted on an eccentric on the output shaft.

16. An oscillatory rotating engine comprising a pair of rotors, each rotor defining a pair of diametrically opposed radially extending lobes, the rotors being mounted coaxially of one another within a cylindrical housing defined by a pair of end walls and a cylindrical wall, the lobes in sealing engagement with the end walls and cylindrical wall of the cylindrical housing to define four working chambers; the rotors being drivingly connected to an output shaft, one of the rotors being connected to the output shaft by means of an internal/external gear train, one of the gears being mounted for rotation with said one rotor, the other gear being rotatably mounted eccentrically one the output shaft so that it meshes with said one gear, said other gear having a formation which engages a complementary formation to prevent free rotation of said other gear, the formation on the other gear being capable of linear and pivotal movement relative to said complementary formation so as to impose an oscillatory rotation on said other gear; said other rotor being drivingly connected to the output shaft for rotation in the same direction as said one rotor and at the same overall velocity ratio; said other gear being rotatably mounted on a link which is constrained to perform orbital motion so that said other gear remains in mesh with said one gear, the output shaft being drivingly connected to the link.

17. An oscillatory rotating engine according to claim 16 in which both rotors are provided with internal/external gear trains, the rotors being mounted on coaxial shafts extending to one side of the cylindrical housing said one gear being drivingly connected to said shafts, said other gears being rotatably mounted on a common link.

* * * * *